US012188385B2

(12) United States Patent
Wang et al.

(10) Patent No.: US 12,188,385 B2
(45) Date of Patent: Jan. 7, 2025

(54) ROCKER ARM ASSEMBLY

(71) Applicant: Eaton Intelligent Power Limited, Dublin (IE)

(72) Inventors: Long Wang, Pudong district (CN); Nicola Andrisani, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/557,150

(22) PCT Filed: Apr. 26, 2022

(86) PCT No.: PCT/EP2022/025186

§ 371 (c)(1),
(2) Date: Oct. 25, 2023

(87) PCT Pub. No.: WO2022/228732

PCT Pub. Date: Nov. 3, 2022

(65) Prior Publication Data

US 2024/0209758 A1 Jun. 27, 2024

Related U.S. Application Data

(60) Provisional application No. 63/269,201, filed on Mar. 11, 2022, provisional application No. 63/179,667, filed on Apr. 26, 2021.

(51) Int. Cl.
*F01L 1/26* (2006.01)
*F01L 1/053* (2006.01)
(Continued)

(52) U.S. Cl.
CPC ..... *F01L 1/267* (2013.01); *F01L 1/053* (2013.01); *F01L 1/181* (2013.01); *F01L 1/22* (2013.01);
(Continued)

(58) Field of Classification Search
CPC . F01L 1/181; F01L 1/2411; F01L 2001/2438; F01L 1/267; F01L 1/46; F01L 2001/467; F01L 13/06
(Continued)

(56) References Cited

U.S. PATENT DOCUMENTS

2017/0276035 A1* 9/2017 Cecur ..... F01L 1/2416
2018/0073401 A1* 3/2018 Andrisani ..... F01L 13/06
(Continued)

FOREIGN PATENT DOCUMENTS

WO 2020/104057 A1 5/2020
WO WO-2020253993 A1 * 12/2020 ..... F01L 1/181

OTHER PUBLICATIONS

International Search Report issued in corresponding application No. PCT/EP2022/025186 dated Aug. 31, 2022, 4 pages.
(Continued)

*Primary Examiner* — Jorge L Leon, Jr.
(74) *Attorney, Agent, or Firm* — Meunier Carlin & Curfman LLC

(57) ABSTRACT

A combined exhaust and engine brake rocker arm assembly (20) configured to selectively open first and second exhaust valves (26, 28) includes a rocker arm body (40), an exhaust rocker arm assembly (16) formed in the rocker arm body (40), and a lost motion spigot assembly (56) including an adjustment nut (70) and guide (62) configured to receive a shaft assembly (60) for adjusting a lash of the lost motion spigot assembly (56). The shaft assembly is disposed within a bore (92) of the adjustment nut below an upper surface thereof, and an engine brake rocker arm assembly (18) is formed in the rocker arm body (40) and configured to operate in a collapse mode and a rigid mode. The lost motion spigot assembly (56) is configured to selectively engage a valve bridge (52) to open the first and second exhaust valves
(Continued)

(26, 28), and the engine brake rocker arm assembly (18) is configured to selectively engage the valve bridge (52) to open only the first exhaust valve (26).

15 Claims, 6 Drawing Sheets

(51) Int. Cl.

| | |
|---|---|
| ***F01L 1/18*** | (2006.01) |
| ***F01L 1/22*** | (2006.01) |
| ***F01L 1/46*** | (2006.01) |
| ***F01L 13/06*** | (2006.01) |
| *F01L 1/24* | (2006.01) |

(52) U.S. Cl.
CPC ..... *F01L 1/46* (2013.01); *F01L 13/06* (2013.01); *F01L 1/2411* (2013.01); *F01L 2001/2438* (2013.01); *F01L 2001/467* (2013.01)

(58) Field of Classification Search
USPC ..... 123/90.4, 90.44
See application file for complete search history.

(56) References Cited

U.S. PATENT DOCUMENTS

| | | | | |
|---|---|---|---|---|
| 2018/0087412 | A1* | 3/2018 | Andrisani | F02D 13/04 |
| 2019/0010835 | A1* | 1/2019 | McCarthy, Jr. | F01L 1/267 |
| 2019/0309664 | A1* | 10/2019 | Batcheller | F01L 1/181 |
| 2020/0325803 | A1* | 10/2020 | Patil | F01L 1/181 |
| 2022/0307389 | A1* | 9/2022 | Edke | F01L 13/065 |
| 2022/0307392 | A1* | 9/2022 | Taylor | F01L 1/267 |
| 2023/0151743 | A1* | 5/2023 | Metsack | F01L 1/053<br>123/90.27 |
| 2023/0383676 | A1* | 11/2023 | Roberts | F01L 1/22 |

OTHER PUBLICATIONS

Written Opinion issued in corresponding application No. PCT/EP2022/025186 dated Aug. 31, 2022, 9 pages.

* cited by examiner

ROCKER ARM ASSEMBLY

CROSS-REFERENCE TO RELATED APPLICATIONS

This is a National Stage application of PCT international application PCT/EP2022/025186, filed on Apr. 26, 2022, which claims priority to U.S. Provisional Patent Application No. 63/179,667, filed Apr. 26, 2021 and U.S. Provisional Patent Application No. 63/269,201, filed Mar. 11, 2022 which are incorporated herein by reference in their entireties.

FIELD

The present disclosure relates generally to rocker arm assemblies for use in a valve train assembly and, more particularly, to a lost motion spigot assembly for an exhaust rocker arm.

BACKGROUND

Compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect of the present disclosure, a combined exhaust and engine brake rocker arm assembly configured to selectively open first and second exhaust valves is provided. The assembly includes a rocker arm body, an exhaust rocker arm assembly formed in the rocker arm body, and a lost motion spigot assembly operably coupled to the exhaust rocker arm and including an adjustment nut and guide configured to receive a shaft assembly for adjusting a lash of the lost motion spigot assembly. The shaft assembly is disposed within a bore of the adjustment nut below an upper surface thereof, and an engine brake rocker arm assembly is formed in the rocker arm body and configured to operate in a collapse mode and a rigid mode. The lost motion spigot assembly is configured to selectively engage a valve bridge to open the first and second exhaust valves, and the engine brake rocker arm assembly is configured to selectively engage the valve bridge to open only the first exhaust valve.

In addition to the foregoing, the described rocker arm assembly may include one or more of the following features: wherein the adjustment nut has a T-shaped cross-section; wherein an upper flange portion of the T-shaped cross-section is not threaded; wherein the shaft assembly includes an upper shaft and a lower shaft extending through the guide, wherein the upper shaft is threaded to an internal bore of the adjustment nut; wherein the guide includes a first step configured to interface with the adjustment nut; and wherein the guide includes a second step configured as a seat for a biasing mechanism.

In addition to the foregoing, the described rocker arm assembly may include one or more of the following features: a cap coupled to the exhaust rocker arm and configured as a second seat for the biasing mechanism; wherein a bore formed in the rocker arm body defines a shoulder configured to provide at least a portion of the biasing mechanism seat along with the second step; and wherein the guide includes a third step configured to engage a stop surface formed on the rocker body; and wherein the second step is set radially inward of the third step, and the first step is set radially inward of the second step.

In addition to the foregoing, the described rocker arm assembly may include one or more of the following features: wherein the engine brake rocker arm assembly further comprises an engine brake capsule coupled to the engine brake rocker arm, the engine brake capsule movable between a retracted position and an extended position, wherein in the retracted position the engine brake capsule does not engage the valve bridge, and in the extended position the engine brake capsule selectively engages the valve bridge to open the first exhaust valve; wherein the engine brake capsule includes an outer housing, a plunger, and a pin assembly; wherein the plunger is disposed in a lower chamber of the outer housing, and the pin assembly is at least partially disposed within an upper chamber of the outer housing; and wherein the engine brake capsule includes a check ball assembly disposed within the lower chamber, the pin assembly operatively associated with the check ball assembly to selectively enable a hydraulic fluid into the lower chamber to move the plunger from the retracted position to the extended position.

In another aspect of the present disclosure, a valvetrain assembly is provided. The valvetrain assembly includes a first engine valve, a second engine valve, a valve bridge operatively associated with the first and second engine valves, and a combined exhaust and engine brake rocker arm assembly configured to selectively open first and second exhaust valves. The rocker arm assembly includes a rocker arm body, an exhaust rocker arm assembly formed in the rocker arm body, and a lost motion spigot assembly operably coupled to the exhaust rocker arm and including an adjustment nut and guide configured to receive a shaft assembly for adjusting a lash of the lost motion spigot assembly. The shaft assembly is disposed within a bore of the adjustment nut below an upper surface thereof, and an engine brake rocker arm assembly is formed in the rocker arm body and configured to operate in a collapse mode and a rigid mode. The lost motion spigot assembly is configured to selectively engage a valve bridge to open the first and second exhaust valves, and the engine brake rocker arm assembly is configured to selectively engage the valve bridge to open only the first exhaust valve.

In addition to the foregoing, the described valvetrain assembly may include one or more of the following features:

wherein the adjustment nut has a T-shaped cross-section; wherein an internal bore of the T-shaped adjustment nut is threaded except for an upper flange portion of the T-shaped cross-section is not threaded, wherein the shaft assembly includes an upper shaft and a lower shaft extending through the guide, wherein the upper shaft is threaded to the threaded internal bore of the adjustment nut; wherein the guide includes a first step configured to interface with the adjustment nut, a second step configured as a seat for a biasing mechanism, and a third step configured to engage a stop surface formed on the rocker body; a cap coupled to the exhaust rocker arm and configured as a second seat for the biasing mechanism, and wherein a bore formed in the rocker arm body defines a shoulder configured to provide at least a portion of the biasing mechanism seat along with the second step; and wherein the second step is set radially inward of the third step, and the first step is set radially inward of the second step.

BRIEF DESCRIPTION OF THE DRAWINGS

The present disclosure will become more fully understood from the detailed description and the accompanying drawings, wherein.

DETAILED DESCRIPTION

Figure 1:
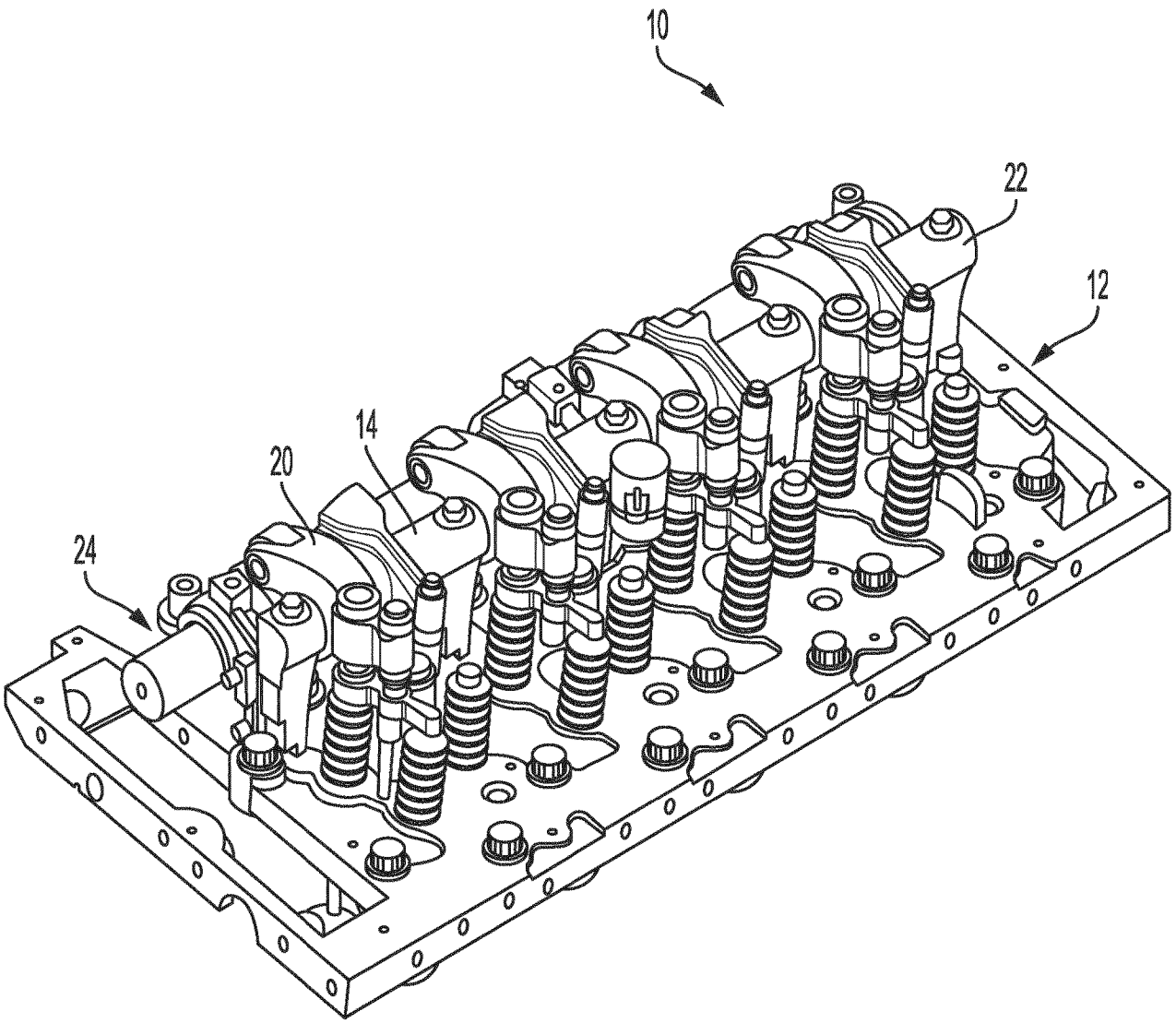
FIG. 1 is a perspective view of a valve train assembly incorporating a rocker arm assembly that includes an intake rocker arm assembly and a combined exhaust rocker arm assembly and engine brake rocker arm assembly, constructed in accordance to one example of the present disclosure.
Figure 2:
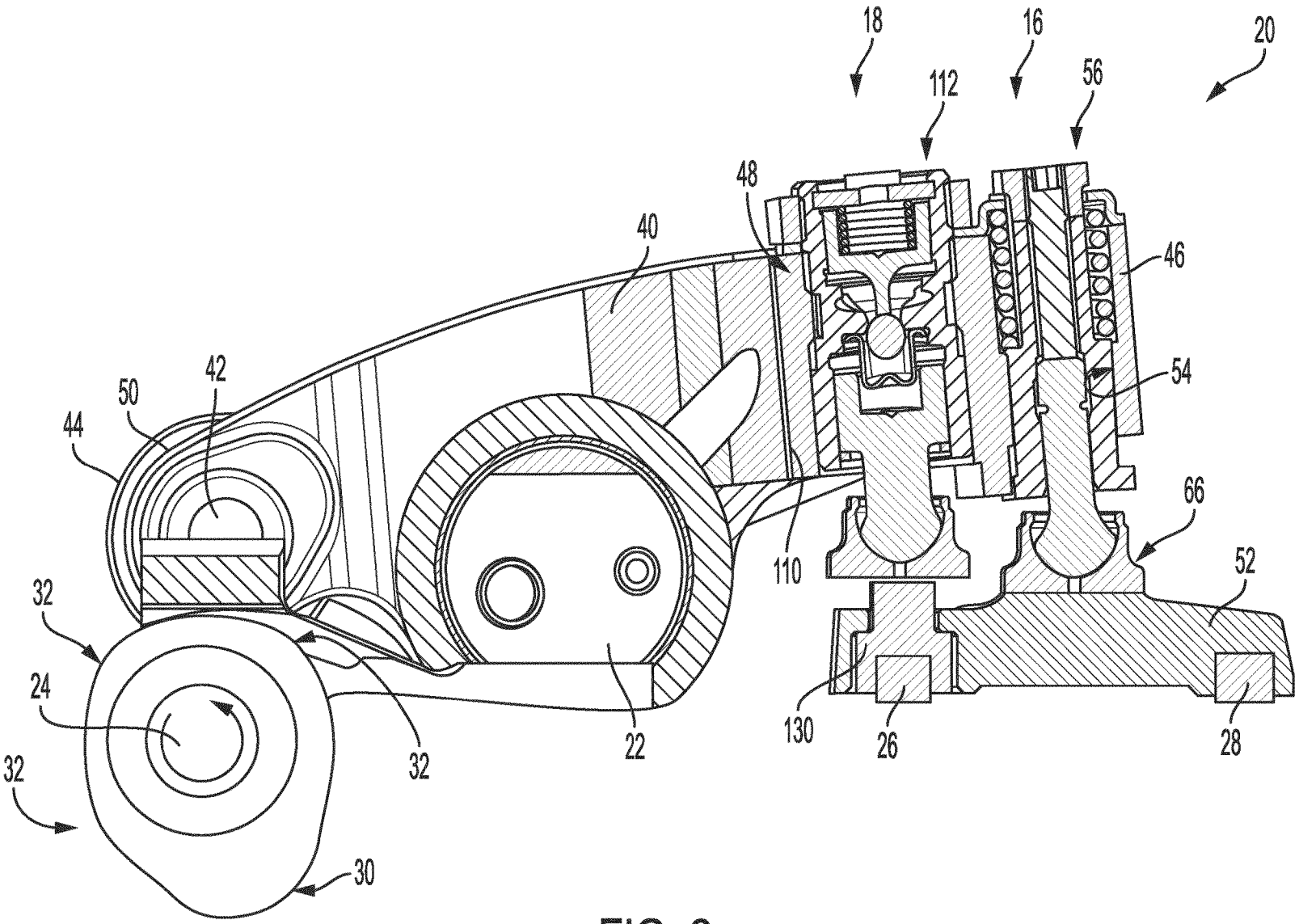
FIG. 2 is a cross-sectional view of the combined rocker arm assembly shown in FIG. 1, including a lost motion spigot assembly and an engine brake capsule constructed in accordance to one example of the present disclosure.

With initial reference to FIGS. 1 and 2, a valve train assembly constructed in accordance to one example of the present disclosure is shown and generally identified at reference 10. The valve train assembly 10 utilizes engine braking and is shown for use in a four-cylinder engine, but it will be appreciated the features described herein may be used in any valve train assembly that utilizes engine braking. The valve train assembly 10 is supported in a valve train carrier 12 and can include two rocker arms per cylinder.

Specifically, each cylinder includes an intake valve rocker arm assembly 14, an exhaust valve rocker arm assembly 16, and an engine brake rocker arm assembly 18. However, as illustrated, the exhaust valve rocker arm assembly 16 and the engine brake rocker arm assembly 18 are combined into a single rocker arm and are collectively referred to as a combined exhaust and engine brake rocker arm assembly 20, which cooperates to control opening of the exhaust valves. The intake valve rocker arm assembly 14 is configured to control motion of the intake valves, the exhaust valve rocker arm assembly 16 is configured to control exhaust valve motion in a drive mode, and the engine brake rocker arm assembly 18 is configured to act on one of the two exhaust valves in an engine brake mode, as will be described herein.

A rocker shaft 22 is received by the valve train carrier 12 and supports rotation of the combined exhaust and engine brake rocker arm assembly 20. As described herein in more detail, the rocker shaft 22 can communicate oil to the rocker arm assemblies 16, 18 during operation. A cam shaft 24 includes lift profiles or cam lobes configured to rotate rocker arm assemblies 16, 18 to activate first and second exhaust valves 26 and 28, as is described herein in more detail. For example, FIG. 2 illustrates cam shaft 24 with an exhaust event lift profile or lobe 30 and a brake event lift profile or lobe 32, which respectively cause combined rocker arm assembly 20 to operate in an exhaust event mode and a brake event mode.

With reference now to FIGS. 2-6, the combined exhaust and engine brake rocker arm assembly 20 will now be further described. The combined rocker arm assembly 20 can generally include a rocker arm body 40, an axle 42, and a roller 44. The rocker arm body 40 includes an exhaust rocker arm portion 46, and an engine brake rocker arm portion 48. Rocker arm body 40 can receive the rocker shaft 22 and defines a pair of flanges 50 to receive the axle 42 such that roller 44 is positioned at least partially therebetween. As such, the axle 42 can be coupled to the rocker arm body 40 and can receive the roller 44, which is configured to be engaged by the exhaust lift lobe 30 or engine brake lobe 32 of the cam shaft 24. This engagement of the roller 44 causes combined rocker arm assembly 20 to rotate about rocker shaft 22 and engage a valve bridge assembly 52, as described herein in more detail.

The exhaust valve rocker arm assembly 16 can include exhaust rocker arm portion 46, which defines a bore 54 configured to at least partially receive a lost motion spigot assembly 56. When roller 44 is engaged by the exhaust lift profile 30, the exhaust rocker arm portion 46 and lost motion spigot assembly 56 can be rotated downward, causing downward movement of the valve bridge assembly 52, which engages the first and second exhaust valve 26 and 28 (FIG. 2) associated with a cylinder of an engine (not shown).

Figure 3:
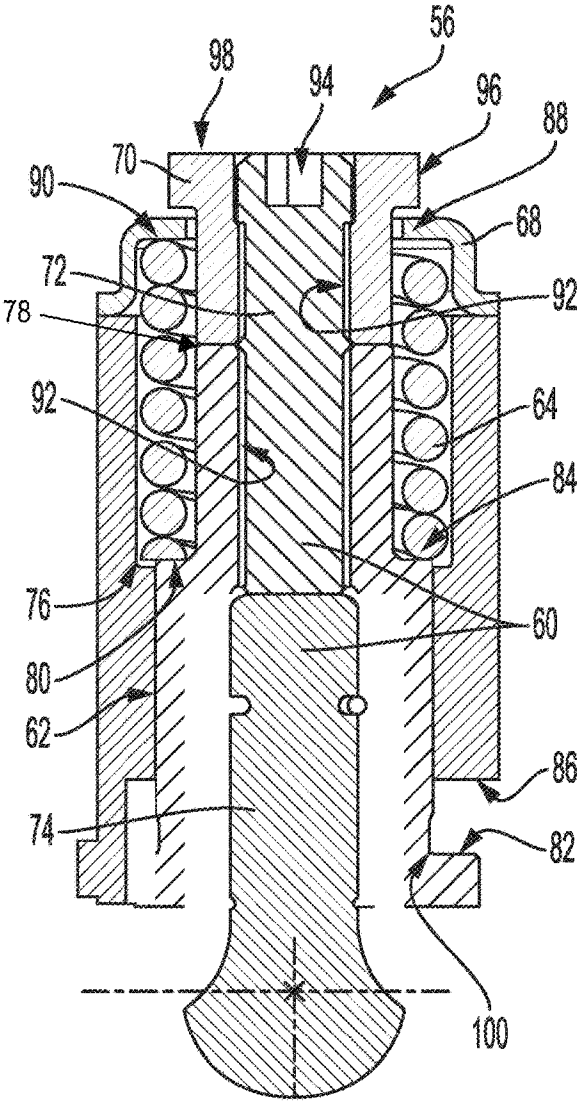
FIG. 3 is an enlarged view of the lost motion spigot assembly shown in FIG. 2.

With particular reference to FIG. 3, the lost motion spigot assembly 56 is disposed within the bore 54 and configured to take up any lash between the lost motion spigot assembly 56 and the valve bridge assembly 52. In the example implementation, the lost motion exhaust-spigot assembly 56 can generally include a shaft assembly 60, a guide 62, a lost motion biasing mechanism 64 (e.g., a spring), an e-foot 66 (FIG. 2), a cap 68, and an adjustment nut 70. The shaft assembly 60 includes an upper shaft 72 and a lower shaft 74 that extend through guide 62, which is disposed within the bore 54.

As shown in the illustrated example, bore 54 defines a shoulder 76, and the guide 62 defines a first step 78, a second step 80, and a third step 82. The first step 78 is configured to interface with the adjustment nut 70. The second step 80, along with the bore shoulder 76, are configured to provide a first seat 84 for one end of the biasing mechanism 64. The third step 82 is configured to selectively engage a stop surface 86 defined on a bottom of the rocker arm body 40 to limit upward motion of the guide 62.

In the example embodiment, the cap 68 is coupled to an upper surface of the rocker arm body 40 and defines an aperture 88 configured to receive adjustment nut 70 therethrough. In this way, the cap 68 is configured to provide a second seat 90 for an opposite end of the biasing mechanism 64, which is configured to bias the guide downward toward the valve bridge assembly 52 and absorb motion during the engine brake mode. The adjustment nut 70 has a generally T-shaped cross-section with the smaller diameter portion extending into the cap 68 and bore 54 radially inward of the lost motion biasing mechanism 64. Both the adjustment nut 70 and the guide 62 define an internal bore 92 configured to receive shaft assembly 60. In the example embodiment, at least a portion of the internal bore 92 is threaded to an outer diameter surface of the upper shaft 72, which includes a tool cavity 94 (e.g., a hex-cavity) configured to receive a tool (not shown) for rotating the upper shaft 72. Notably, in the example embodiment, an upper flange portion 96 of the T-shaped nut 70 is not threaded with the upper shaft 72 to reduce or prevent torque load impact.

Rotation of the upper shaft 72 is configured to move/constrain the lower shaft 74 for setting the desired lash of the lost motion spigot assembly 56. In this way, the e-foot 66 is coupled to or operably associated with the lower shaft 74, and the adjustment nut 70 is threadably secured to the upper shaft 72. Utilizing the tool, the upper shaft 72 can be rotated downward until there is no lash at a gage block (not shown) temporarily placed between the third step 82 and the stop surface 86. In this way, the valve lash set at a predetermined contact point (e.g., central contact point) of the valve bridge assembly 52 may be adjusted by way of shaft assembly 60 and adjustment nut 70 to provide a desired lost motion stroke (LMS).

Accordingly, the lost motion spigot assembly 56 provides numerous advantages, including lost motion capability with a reduced height and simplified adjustment maintenance compared to known systems. Additionally, the upper shaft 72 at the tool cavity 94 is unthreaded to facilitate preventing torque load impact, while the tool cavity 94 is concealed within the adjustment nut 70 below a top surface 98 thereof to provide increased clearance gap between the lost motion spigot assembly 56 and the engine cover (not shown). Upper flange portion 96 facilitates integrating the shaft assembly 60 into the combined rocker arm assembly 20. Moreover, a length of adjustment nut 70 is variable based on design since the interface area between the adjustment nut 70 and guide 62 (i.e., the first step 78) does not contact the biasing mechanism 64. The bore shoulder 76 at least partially defines the first seat 84 for one end of the biasing mechanism 64 to facilitate setting the desired lash.

Figure 4:
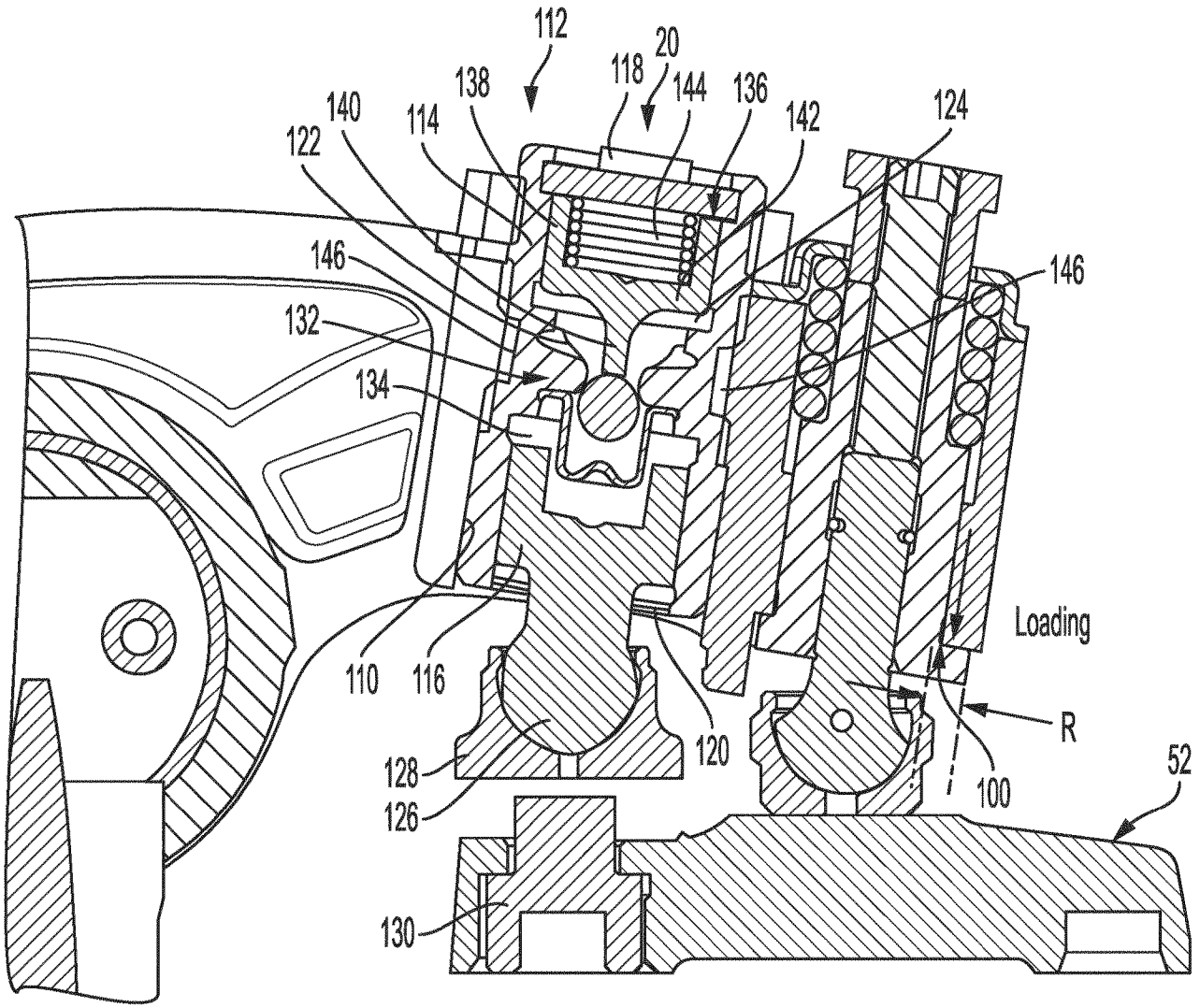
FIG. 4 is another cross-sectional view of the combined rocker arm assembly shown in FIG. 2 at exhaust valves full open.
Figure 5:
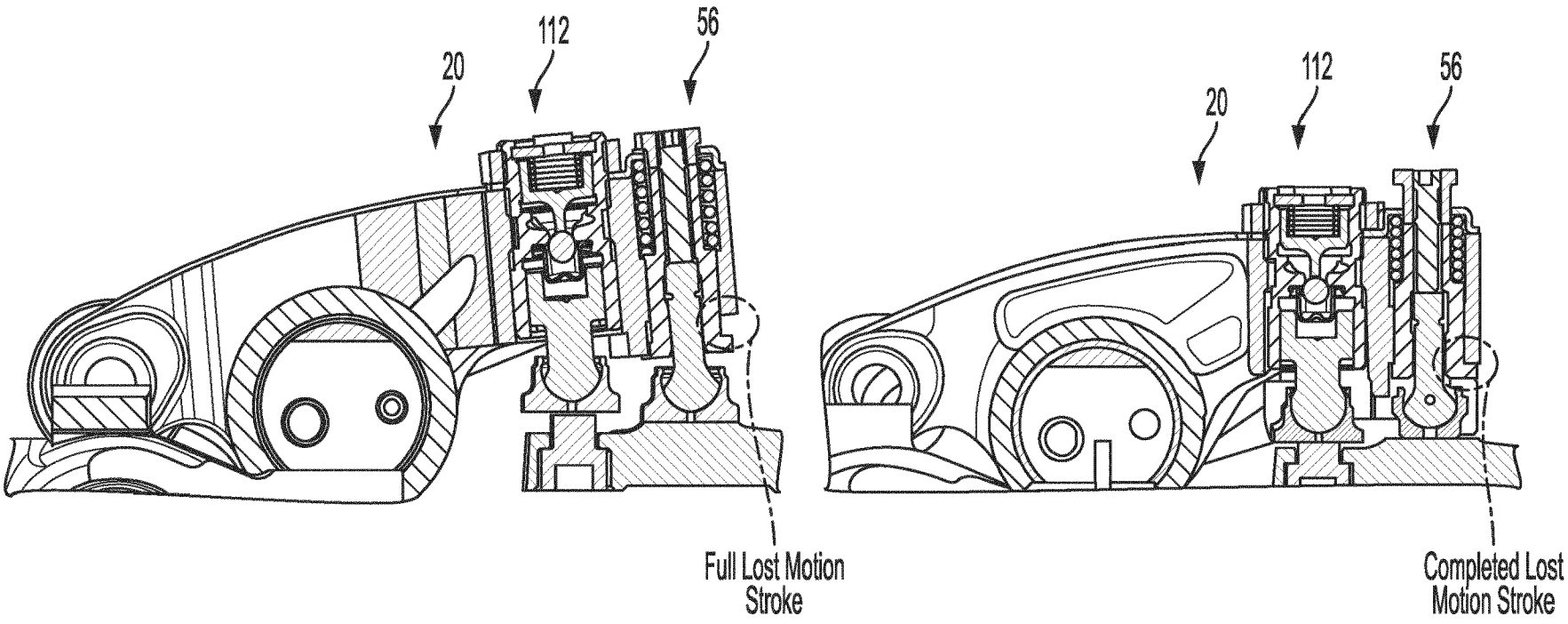
FIG. 5 illustrates cross-sectional views of the combined rocker arm assembly shown in FIG. 2 in a full lost motion stroke and a completed lost motion stroke.

Advantageously, the length of guide 62 is disposed toward a bottom of the lost motion spigot assembly 56, thereby allowing the guide top portion to be shorter due to bias torque load reduction compared to conventional systems. Wear is also reduced because of torque load improvement and stiffness enhancement. As shown in FIG. 4, load stress at corner 100 is reduced since the bending arm 'R' is shortened compared to conventional systems. Such a system also enables the diameter of lower shaft 74 to be larger, for example to increase stiffness and ability to bear more bending load, since guide 62 can have a larger diameter.

With continued reference to FIGS. 2 and 4, the exhaust valve rocker arm assembly 16 includes engine brake rocker arm portion 48, which defines a bore 110 configured to at least partially receive an engine brake capsule assembly 112. When roller 44 is engaged by the engine brake lift profile 32, the engine brake rocker arm portion 48 and engine brake capsule assembly 112 can be rotated downward, causing downward movement of the valve bridge assembly 52, which engages only the first exhaust valve 26 (i.e., not valve 28), as described herein in more detail.

In the example embodiment, engine brake capsule assembly 112 is configured to selectively move from a collapsing mode to a rigid mode to selectively transfer cam motion to the first exhaust valve 26 during an engine braking event. As shown in FIG. 4, in one example implementation, the engine brake capsule assembly 112 can generally include an outer housing 114, a plunger 116, and a cap 118. The outer housing 114 can be received by the bore 110 of the engine brake rocker arm portion 48 and can generally include a lower chamber 120, an intermediate chamber 122, and an upper chamber 124. The plunger 116 is slidably received within lower chamber 120 and at one end includes a spigot 126 attached to an e-foot 128. As shown, the e-foot 128 is configured to act against a valve pin 130, which slidingly disposed within the valve bridge assembly 52.

A check ball assembly 132 can be disposed in the lower chamber 120. The check ball assembly 132 can be configured to hold oil within a space or area 134 between the plunger 116 and the intermediate chamber 122. A pin assembly 136 is disposed in the upper chamber 124 and includes a main body 138 and a pin arm 140. The main body 138 defines a seat 142 configured to receive a biasing mechanism 144 (e.g., a spring), and pin arm 140 extends downwardly from the main body into the intermediate chamber 122. The biasing mechanism 144 is configured to rest against the cap 118 and bias the pin assembly 136 downward into contact with the check ball assembly 132.

Oil can be supplied to the intermediate chamber 122 via, for example, the rocker shaft 22 and through ports 146. The upward pressure of the fluid supply compresses the biasing mechanism 144 such that pin assembly 136 is moved away from the check ball assembly 132. This movement allows the oil in intermediate chamber 122 to fill area 134 and move plunger 116 downward and outward into an extended position to engage the valve pin 130 (e.g., a brake mode). When the supply of oil ceases, the oil in intermediate chamber 122 can be at least partially evacuated and plunger 116 is able to slide upward into lower chamber 120 when the plunger 116 comes into contact with the valve pin 130 (e.g., drive mode).

Thus, the engine brake capsule assembly 112 can be selectively operated between the brake mode and the drive mode. In the brake mode, pressurized oil is selectively supplied to ports 146 to move the plunger downward into the extended position. In the drive mode, the oil supply to ports 146 is suspended, and the plunger 116 returns to the retracted position within the lower chamber 120 of outer housing 114.

As such, during operation of combined rocker arm assembly 20, the exhaust valve rocker arm assembly 16 can selectively engage the valve bridge assembly 52 to actuate the first and second exhaust valves 26, 28 and perform a normal exhaust event (combustion mode); whereas, the engine brake rocker arm assembly 18 can selectively engage the valve pin 130 to only actuate the first exhaust valve 26 and perform a brake event actuation (engine braking mode).

As previously noted, the engine brake capsule assembly 112 is configured to move the plunger 116 between the retracted position and the extended position. In the retracted position, the plunger 116 is withdrawn into the outer housing lower chamber 120 such that the plunger 116 is spaced apart from and does not contact the valve pin 130 even when the cam lobe (e.g., lobe 32) of camshaft 24 engages the combined rocker arm assembly 20.

However, in the extended position, the plunger 116 extends from the outer housing lower chamber 120 such that plunger 116 is positioned to engage the valve pin 130. When the cam lobe engages the combined rocker arm assembly 20, plunger 116 engages valve pin 130 to open the first exhaust valve 26 and perform the brake event actuation. FIG. 2 shows engine brake capsule assembly 112 in the extended position as a result of oil being supplied through ports 146. In this position, engine brake event actuation is active, and engine brake capsule assembly 112 is configured to engage the valve pin 130. The engine brake event actuation capability may be deactivated by ceasing the oil supply through ports 146, thereby causing the engine brake capsule assembly 112 to move to the retracted position.

Figure 6:
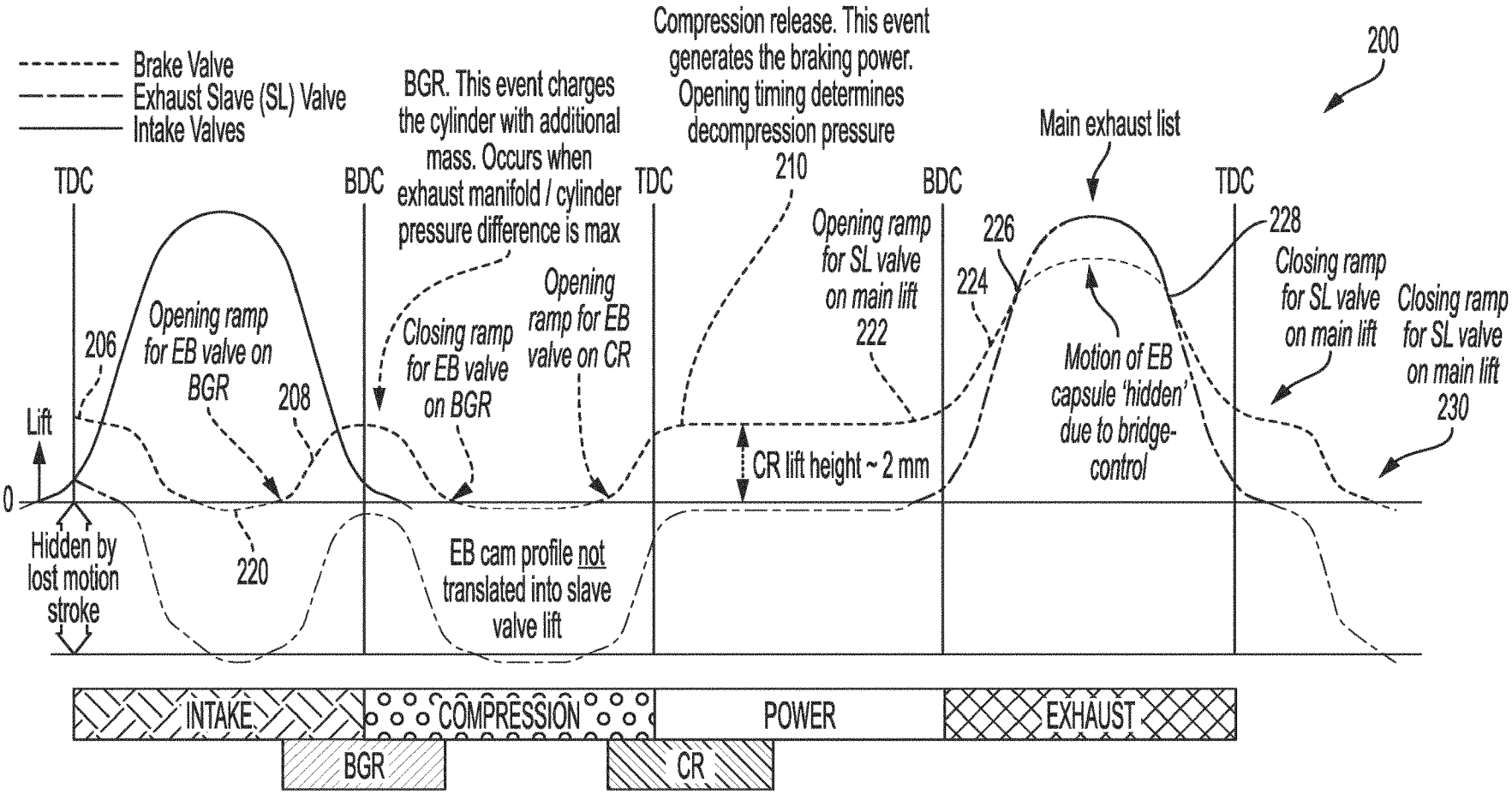
FIG. 6 is a graph illustrating an example valve lift profile of the valve train assembly shown in FIG. 1.

Turning now to FIG. 6, a plot 200 is shown illustrating an example operation of valvetrain assembly 10 in the brake mode. Plot 200 illustrates an intake valve lift 202, an exhaust valve lift 204 of the exhaust valves 26, 28, an engine brake exhaust valve lift 206 of one exhaust valve 26, an engine brake exhaust lift with brake gas recirculation (BGR) 208, and compression release (CR) 210. Opening only one exhaust valve 26 instead of both exhaust valves 26, 28 (e.g., drive mode) allows the engine brake exhaust valve 26 to open later in the compression stroke and in that way offer higher braking power.

With continued reference to FIGS. 2 and 4-6, an example method of operating the valvetrain assembly 10 is described in more detail. When the engine is in the drive (combustion mode), a controller (not shown) supplies no fluid or low pressure fluid (e.g., oil) to the engine brake capsule assembly 112 such that the engine brake capsule operates in the collapse mode. Thus, when motion of the cam lift profile 32 causes rotation of the exhaust rocker arm body 40, the engine brake capsule assembly 112 collapses and does not transfer motion to the exhaust valve 26. Moreover, at the same time, motion of the spigot assembly 56 is absorbed by lost motion biasing mechanism 64 such that motion is not transferred to the valve bridge assembly 52.

As the exhaust cam lift profile 30 rotates rocker arm body 40 even farther to where spigot assembly 56 no longer absorbs rocker arm motion (e.g., FIG. 5), the spigot assembly 56 causes downward movement of the valve bridge assembly 52 and opens exhaust valves 26, 28 during the standard time (exhaust stroke). The cam lift profile returns to the base circle and exhaust valves 26, 28 close at the standard time (end of exhaust stroke).

In braking mode, operation begins when the base circle of the cam lift profile engages the combined rocker arm assembly 20, represented as point 220 (FIG. 6). In this position, the controller supplies high pressure fluid to the engine brake capsule assembly 112 thereby transitioning the brake capsule to the rigid mode (e.g., FIG. 2). Accordingly, when motion of the brake event cam lift profile 32 causes rotation of the combined rocker arm assembly 20 at point 222 (FIG. 6), the rigid engine brake capsule assembly 112 transfers motion to the exhaust valve 26 via bridge pin 130. At this time, spigot assembly 56 operates in lost motion such that motion is not transferred to the valve bridge 52 or exhaust valve 28.

At point 224 (FIG. 6), the exhaust cam lift profile 30 rotates rocker arm assembly 20 even farther to where lost motion biasing mechanism 64 no longer absorbs rocker arm motion, thereby causing downward movement of spigot assembly 56 and valve bridge 52, thus opening exhaust valve 28. Point 226 (FIG. 6) represents a point where the engine brake exhaust valve 26 becomes controlled by the valve bridge 52. Point 228 (FIG. 6) represents a point where the engine brake valve 26 again becomes controlled by the engine brake capsule assembly 112. At point 230 (FIG. 6), the rocker arm assembly 20 moves to the closed position as the cam lift profile returns to base circle.

Described herein are systems and methods for a single rocker arm assembly configured to selectively perform exhaust and engine braking events on an engine. The system includes a single rocker arm having an exhaust rocker arm assembly and an engine brake rocker arm assembly. The exhaust rocker arm assembly selectively engages a valve bridge to actuate two valves to perform an exhaust event. The engine brake rocker arm assembly includes a brake capsule assembly configured to selectively transfer motion to a portion of the valve bridge to thereby actuate one of the two valves and perform an engine brake event.

In one aspect, the exhaust rocker arm includes a lost motion spigot assembly that provides a top spring location and adjustment nut for a type III or type V valve train system. The adjustment nut is T-shaped with a portion extending into the rocker arm to reduce assembly height. Additionally, a three-step hollow guide enables the top spring location and obviates the need for a spring seat collar, while improving bias torque and reducing wear.

As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A combined rocker arm assembly for selectively opening first and second exhaust valves, the combined rocker arm assembly comprising:

a rocker arm body;

an exhaust rocker arm assembly formed in the rocker arm body;

a lost motion spigot assembly operatively coupled to the exhaust rocker arm assembly via a first bore formed in the rocker arm body, the lost motion spigot assembly including an adjustment nut and a guide which cooperate so as to define an internal bore;

a shaft assembly arranged in the internal bore below an upper surface of the adjustment nut, the shaft assembly configured to adjust a lash of the lost motion spigot assembly; and an engine brake rocker arm assembly formed in the rocker arm body, the engine brake rocker arm assembly configured to alternately operate in a collapse mode and a rigid mode, wherein the lost motion spigot assembly is configured to selectively engage a valve bridge so as to open the first and second exhaust valves, wherein the engine brake rocker arm assembly is further configured to selectively engage the valve bridge so as to open only the first exhaust valve when operating in the rigid mode, wherein the guide includes a first step configured to interface with the adjustment nut, and a second step configured to interface with a biasing mechanism, and wherein the first bore includes a shoulder configured to cooperate with the second step so as to define a first biasing mechanism seat for the biasing mechanism.

2. The combined rocker arm assembly of claim 1, wherein the adjustment nut includes a T-shaped cross-section.

3. The combined rocker arm assembly of claim 2, wherein a portion of the internal bore corresponding to an upper flange portion of the T-shaped cross-section is not threaded.

4. The combined rocker arm assembly of claim 2, wherein the shaft assembly includes an upper shaft and a lower shaft collectively extending through the guide, and wherein the upper shaft is threaded to a remaining portion of the internal bore at the adjustment nut.

5. The combined rocker arm assembly of claim 1, further comprising a cap coupled to the exhaust rocker arm assembly, the cap configured as a second biasing mechanism seat for the biasing mechanism.

6. The combined rocker arm assembly of claim 1, wherein the guide further includes a third step configured to engage a stop surface formed on the rocker arm body.

7. The combined rocker arm assembly of claim 6, wherein the second step is set radially inward of the third step, and the first step is set radially inward of the second step.

8. The combined rocker arm assembly of claim 1, wherein the engine brake rocker arm assembly includes an engine brake capsule configured to switch between a retracted position and an extended position, wherein the engine brake capsule does not engage the valve bridge when in the retracted position, and wherein the engine brake capsule selectively engages the valve bridge when in the extended position so as to open the first exhaust valve.

9. The combined rocker arm assembly of claim 8, wherein the engine brake capsule includes an outer housing, a plunger, and a pin assembly.

10. The combined rocker arm assembly of claim 9, wherein the plunger is disposed in a lower chamber of the outer housing, and the pin assembly is at least partially disposed within an upper chamber of the outer housing.

11. The combined rocker arm assembly of claim 10, wherein the engine brake capsule further includes a check ball assembly disposed within the lower chamber, the pin assembly operatively associated with the check ball assembly so as to selectively enable a hydraulic fluid into the lower chamber such that the plunger moves from the retracted position to the extended position.

12. A valvetrain assembly comprising:

a first engine valve;

a second engine valve;

a valve bridge operatively associated with the first and second engine valves; and a combined rocker arm assembly configured to selectively open the first and second engine valves, the combined rocker arm assembly comprising:

a rocker arm body;

an exhaust rocker arm assembly formed in the rocker arm body;

a lost motion spigot assembly operatively coupled to the exhaust rocker arm assembly via a first bore formed in the rocker arm body, the lost motion spigot assembly including an adjustment nut and a guide which cooperate so as to define an internal bore;

a shaft assembly arranged in the internal bore below an upper surface of the adjustment nut, the shaft assembly configured to adjust a lash of the lost motion spigot assembly; and an engine brake rocker arm assembly formed in the rocker arm body, the engine brake rocker arm assembly configured to alternately operate in a collapse mode and a rigid mode, wherein the lost motion spigot assembly is configured to selectively engage the valve bridge so as to open the first and second engine valves, wherein the engine brake rocker arm assembly is further configured to selectively engage the valve bridge so as to open only the first engine valve when operating in the rigid mode, wherein the adjustment nut includes a T-shaped cross-section, wherein a portion of the internal bore at the adjustment nut is threaded except for a portion of the internal bore corresponding to an upper flange portion of the T-shaped cross-section that is not threaded, wherein the shaft assembly includes an upper shaft and a lower shaft collectively extending through the guide, and wherein the upper shaft is threaded to the threaded portion of the internal bore at the adjustment nut.

13. The valvetrain assembly of claim 12, wherein the guide includes:

a first step configured to interface with the adjustment nut;

a second step configured as a seat for a biasing mechanism; and a third step configured to engage a stop surface formed on the rocker arm body.

14. A valvetrain assembly comprising:

a first engine valve;

a second engine valve;

a valve bridge operatively associated with the first and second engine valves;

a combined rocker arm assembly configured to selectively open the first and second engine valves, the combined rocker arm assembly comprising:

a rocker arm body;

an exhaust rocker arm assembly formed in the rocker arm body;

a lost motion spigot assembly operatively coupled to the exhaust rocker arm assembly via a first bore formed in the rocker arm body, the lost motion spigot assembly including an adjustment nut and a guide which cooperate so as to define an internal bore;

a shaft assembly arranged in the internal bore below an upper surface of the adjustment nut, the shaft assembly configured to adjust a lash of the lost motion spigot assembly; and an engine brake rocker arm assembly formed in the rocker arm body, the engine brake rocker arm assembly configured to alternately operate in a collapse mode and a rigid mode, wherein the lost motion spigot assembly is configured to selectively engage the valve bridge so as to open the first and second engine valves, wherein the engine brake rocker arm assembly is further configured to selectively engage the valve bridge so as to open only the first engine valve when operating in the rigid mode, wherein the guide includes:

a first step configured to interface with the adjustment nut;

a second step configured to interface with a biasing mechanism; and a third step configured to engage a stop surface formed on the rocker arm body, wherein the first bore includes a shoulder configured to cooperate with the second step so as to define a first biasing mechanism seat for the biasing mechanism, and wherein the exhaust rocker arm assembly includes a cap configured as a second biasing mechanism seat for the biasing mechanism.

15. The valvetrain assembly of claim 14, wherein the second step is set radially inward of the third step, and the first step is set radially inward of the second step.

* * * * *